United States Patent [19]

Crosman

[11] Patent Number: 4,463,520

[45] Date of Patent: Aug. 7, 1984

[54] SELF-RETURNING TOY VEHICLE

[75] Inventor: Dorland L. Crosman, Bloomfield, N.J.

[73] Assignee: Buddy L Corporation, New York, N.Y.

[21] Appl. No.: 477,354

[22] Filed: Mar. 21, 1983

[51] Int. Cl.[3] ..... A63H 17/40

[52] U.S. Cl. ..... 446/443

[58] Field of Search ..... 46/212, 206, 211, 213, 46/262, 263

[56] References Cited

U.S. PATENT DOCUMENTS

| | | | |
|---|---|---|---|
| 463,715 | 7/1910 | Kingsbury et al. | 46/212 |
| 2,618,101 | 11/1952 | Berger | 46/212 |
| 2,784,527 | 3/1957 | Sarff | 46/213 X |
| 2,830,403 | 4/1958 | Foster | 46/212 X |
| 2,943,418 | 7/1960 | Smith | 46/212 X |

FOREIGN PATENT DOCUMENTS

| | | | |
|---|---|---|---|
| 473376 | 10/1937 | United Kingdom | 46/212 |

*Primary Examiner*—Mickey Yu

*Attorney, Agent, or Firm*—Michael Ebert

[57] ABSTRACT

A toy vehicle which when propelled by a player from a starting point along a flat surface in the forward direction, acts to store energy, the vehicle at the end of its forward run being caused by the stored energy to reverse its orientation as it runs back toward the starting point. The vehicle includes a chassis having a front cowl section projecting therefrom below which is a front wheel carriage coupled to the cowl by a pivot pin, whereby the carriage orientation is reversible relative to the cowl. The carriage has a spring motor therein operatively coupled to the front wheel axle which when rotated during the forward run of the vehicle acts to wind the motor. The rear wheel axle is supported in bearings below the rear section of the chassis, one of which is slotted to permit angular displacement of the axle. At the end of the forward run, the energized motor then acts to drive the front wheel carriage in the reverse direction to cause angular displacement of the rear axle, as a result of which the chassis swings in an arc to assume a position behind the front wheel carriage as it returns toward the starting point.

7 Claims, 13 Drawing Figures

SELF-RETURNING TOY VEHICLE

BACKGROUND OF INVENTION

Field of Invention

This invention relates generally to wheeled toys which run on a flat surface, and more particularly to a toy vehicle such as an auto or racing car which when propelled by a player in the forward direction from a starting point, acts to wind a spring motor to store energy therein, the vehicle at the conclusion of its forward run being caused by the energized spring motor to reverse its orientation as it runs back toward its starting point.

Toy vehicles are known which include a clockwork spring motor that is wound by pressing the car on the ground and pushing the car forward a few feet. In this arrangement, the front wheels of the vehicle are operatively coupled to the spring of the motor so that the forward movement of the vehicle acts to wind the spring. When the car is then released by the player, the energized spring acts through a gear train to drive the wheels to cause the car to move forward until the motor is exhausted.

The practical difficulty with a known vehicle of this type is that at the end of the run, the vehicle is then a fair distance from its starting point; hence the player must go after the vehicle in order to again play with it. This limits the play value of the vehicle, for the player quickly tires of having to recover the vehicle after each play.

In order to overcome this drawback, U.S. Pat. Nos. 2,104,365 and 2,606,402 to Fuchs disclose a toy car having a spring motor and a reversing wheel in an arrangement in which the direction of motion is changed when a bumper coupled to this wheel comes in contact with an obstacle. If, however, the spring motor is exhausted before the vehicle encounters an obstacle, there will be no reversing action.

Another approach to the problem of reversal is that described in the Foster U.S. Pat. No. 2,830,403 in which a toy car is provided with a spring motor coupled by a cable to a cone mounted on the axle of the rear wheels. When the car is propelled forward by the player, the turning rear wheels cause the cable to coil itself on the cone, and in doing so to wind up the motor. At the end of the run, the wound motor then unwinds to uncoil the cable and turn the wheels in the reverse direction, causing the vehicle to return to its starting point.

The main objection to the Foster arrangement is that the vehicle in its return trip travels backwards; hence this movement is unrealistic and not comparable to that of an actual car which, before returning to its starting point, turns around at the end of its forward run.

SUMMARY OF INVENTION

In view of the foregoing, the main object of this invention is to provide a toy vehicle which when propelled by a player in a forward direction from a starting point acts to wind a spring motor to store energy therein, and which at the conclusion of its forward run is caused by the energized spring motor to reverse its orientation as it runs back toward its starting point.

While the invention will be described in the context of a wheeled toy which simulates an automobile, it is to be understood that it is applicable to doll carriages, animal forms and other configurations which can be mounted on the chassis of the device in lieu of an automotive or other vehicular body.

A significant advantage of the invention is that the wheeled toy propelled by a player from a starting point comes back to this point or close to it, so that the player need not go after the vehicle after each play. Hence the player, without leaving his station, may repeatedly play with his toy and send it off in various directions, the toy always returning to the player. Moreover, since the toy at the end of its run re-orients itself as it goes back to the player, it does not travel backwards but maintains its normal travel orientation.

Also an object of the invention is to provide a wheeled toy which is of relatively simple mechanical design which may be mass-produced at low cost, and which operates reliably and efficiently.

Briefly stated, these objects are accomplished in a toy vehicle which when propelled by a player from a starting point along a flat surface in the forward direction, acts to store energy, the vehicle at the end of its forward run being caused by the stored energy to reverse its orientation as it runs back toward the starting point. The vehicle includes a chassis having a front cowl section projecting therefrom below which is a front wheel carriage coupled to the cowl by a pivot pin, whereby the carriage orientation is reversible relative to the cowl. The carriage has a spring motor therein operatively coupled to the front wheel axle which when rotated during the forward run of the vehicle acts to wind the motor. The rear wheel axle is supported in bearings below the rear section of the chassis, one of which is slotted to permit angular displacement of the axle. At the end of the forward run, the energized motor then acts to drive the front wheel carriage in the reverse direction to cause angular displacement of the rear axle, as a result of which the chassis swings in an arc to assume a position behind the front wheel carriage as it returns toward the starting point.

In order to restore the carriage to its initial orientation prior to a replay, a spring-biased gear mechanism is coupled to the pivot pin, the mechanism being charged as the chassis swings behind the carriage and acting, when the vehicle is lifted from the surface upon the completion of a play, to rotate the carriage so that it resumes its initial position.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
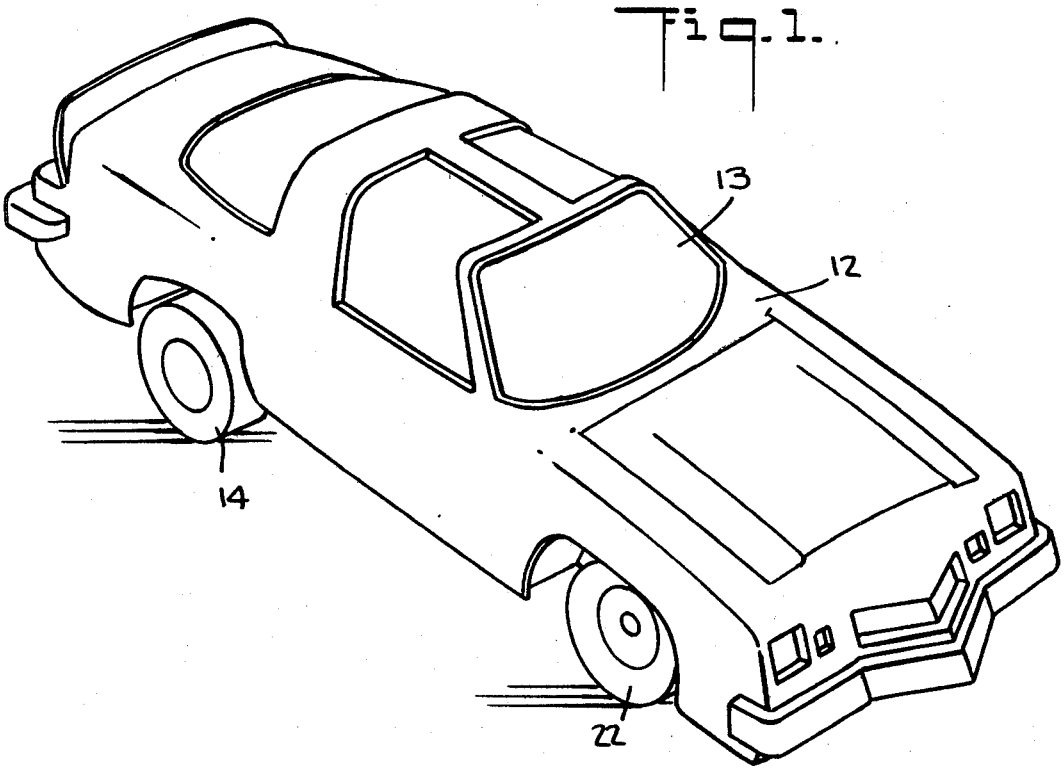
FIG. 1 is a perspective view of a vehicle in accordance with the invention.
Figure 2:
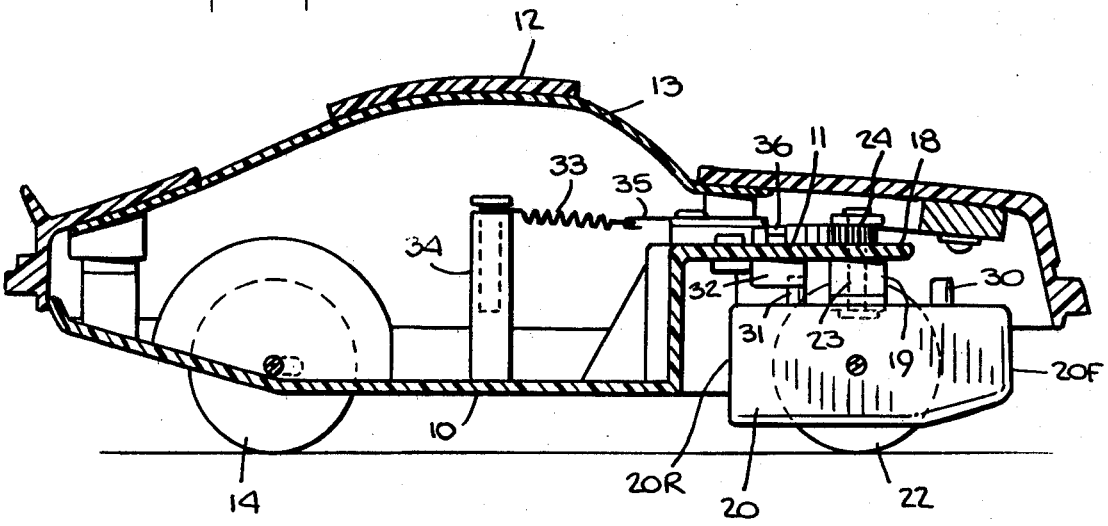
FIG. 2 is a longitudinal section taken through the vehicle.

Referring now to FIGS. 1 and 2, there is shown a vehicle in accordance with the invention, the vehicle chassis 10 having a front cowl 11 projecting therefrom. A body 12 is supported on the chassis and secured thereto by screws. Inserted within body 10, which is shaped to have the appearance of a sports car, is a molded plastic shell 13 serving to simulate the windshield as well as the rear and side windows of the vehicle.

In practice, this four-wheeled toy may take many other forms, such as that of a truck, a fire engine, a doll carriage or even a wheeled animal, in which case in lieu of a car body supported on chassis 10, an appropriately shaped form is mounted thereon.

Figure 4:
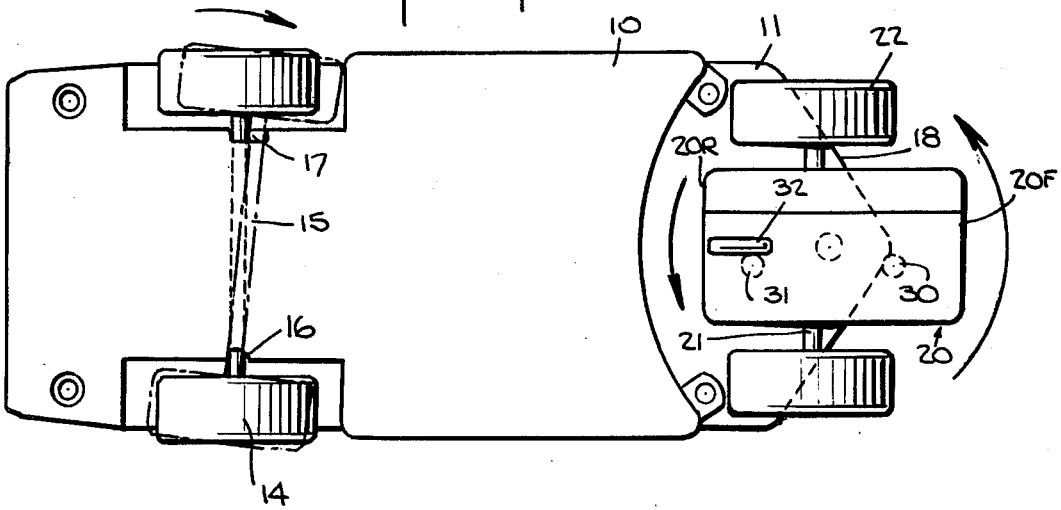
FIG. 4 is a bottom view of the chassis.
Figure 5:
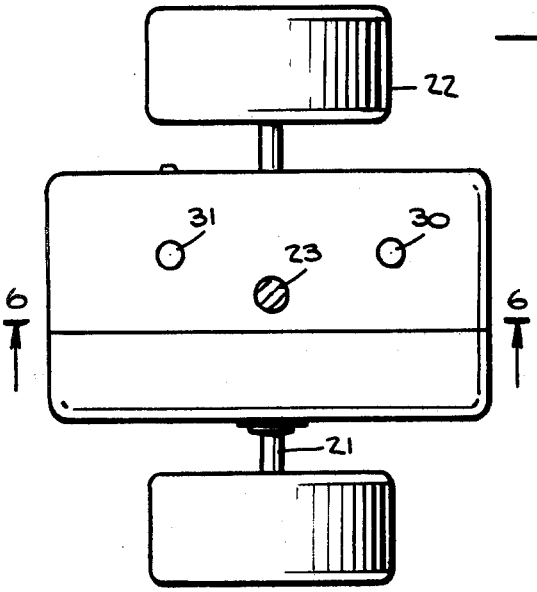
FIG. 5 is a top view of the front wheel carriage.
Figure 6:
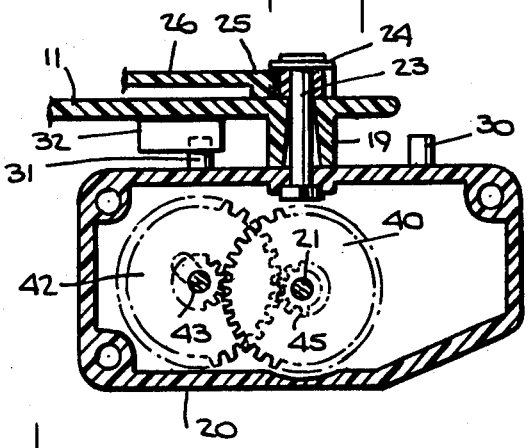
FIG. 6 is a side view of the carriage.
Figure 7:
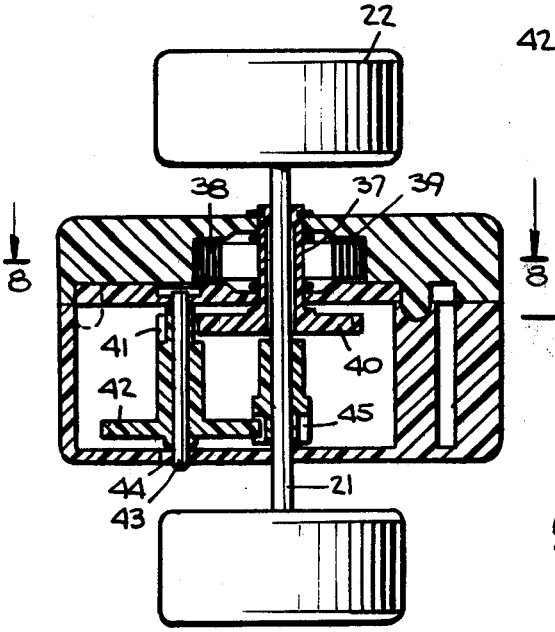
FIG. 7 is a section taken through the carriage in the horizontal plane to expose the gear works associated with the spring.
Figure 8:
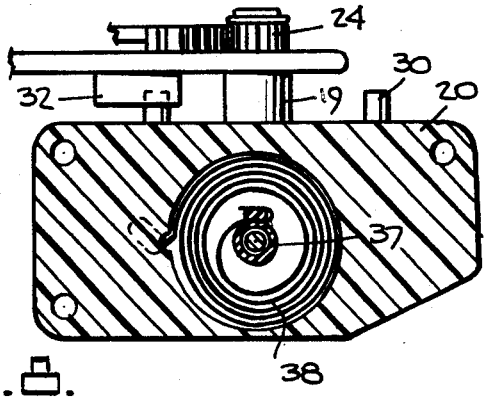
FIG. 8 is a section taken through the carriage in the vertical plane to expose the spring.

Rear wheels 14, as best seen in FIG. 4, are supported on an axle 15 which extends through bearing holes 16 and 17 on opposite sides of the rear section of the chassis. Hole 16 is dimensioned to accommodate the axle and hole 17 is slotted to permit angular displacement thereof relative to hole 16.

Cowl 11 is provided with a triangular forward ledge 18 having a sleeve 19 depending therebelow adjacent its apex. Pivotally supported below cowl 11 is a front wheel truck or carriage 20 having a frame wheel axle 21 extending transversely therethrough, front wheels 22 being secured to the opposite ends of this axle. A vertical pivot pin 23 is anchored at the center of the top wall of the carriage. This pin passes through sleeve 19 and terminates in a pinion 24 which turns on the upper face of triangular ledge 18.

Figure 3:
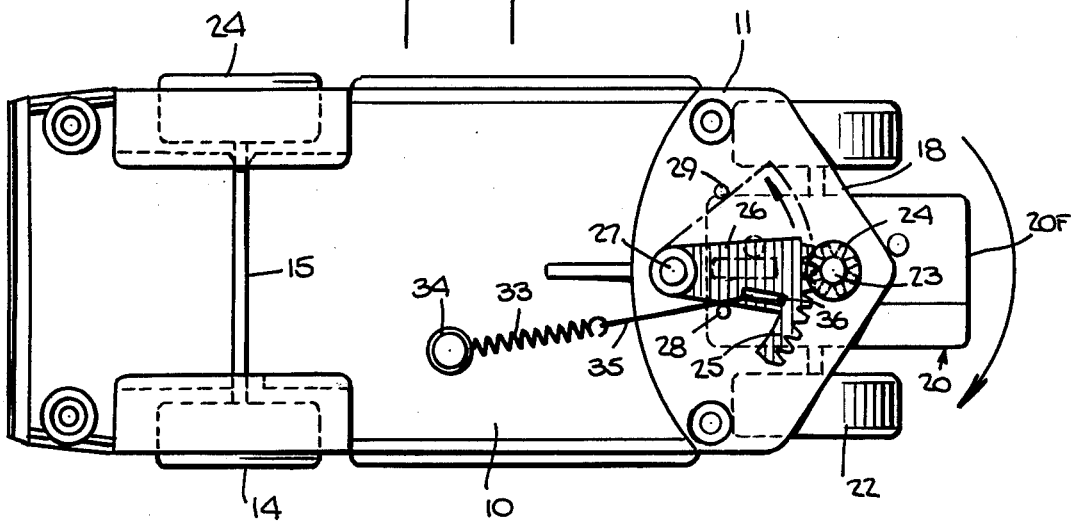
FIG. 3 is a top view of the chassis with the body removed.

Pinion 24, as best seen in FIG. 3, engages the teeth of a flat sector gear 25 supported at one end of arm 26 whose other end is pivoted by pin 27 on the side of cowl 11 opposed to the apex of the triangular ledge, so that pivot pins 23 and 27 both lie on the longitudinal center axis of the chassis. The angular swing of arm 26 is restricted by stops 28 and 29 placed on either side thereof.

Carriage 20 is rotatable 180° relative to cowl 11 to assume either its normal orientation, as shown in FIG. 2, wherein the inclined front wall 20F faces the front of the vehicle, or the reverse orientation in which the vertical rear wall 20R then faces the front of the vehicle. To restrict the position of carriage 20 to either orientation, the upper wall of the carriage is provided with front and rear stops 30 and 31 which cooperate with an abutment 32 depending from ledge 18 behind sleeve 19.

A helical spring 33 is provided, one end of which is secured to a vertical post 34 anchored on chassis 11, the other end being connected by a wire 35 to a slot 36 formed in arm 26. This spring acts to urge sector gear 25 to assume its minimum position relative to pinion 24, as shown in FIG. 3. When, however, the carriage orientation undergoes reversal, pinion 24 turns to cause sector gear 25 to assume its maximum position, thereby tensioning spring 33. Hence, when the vehicle is thereafter lifted from its running surface, the tensioned spring then pulls back the sector gear to cause the carriage to return to its initial orientation.

Referring now to FIGS. 5 to 8, it will be seen that front wheel axle 21 passes freely through an arbor 37 which is attached to the inner end of a spiral flat spring 38. This spring surrounds axle 21 and is housed within a cavity 39 formed in one side wall of the carriage. Mounted on arbor 37 is an arbor gear 40 which engages the pinion 41 of a cluster gear 42 mounted on an axle 43 parallel to front wheel axle 21. One end of this axle is supported in a slotted bearing 44 on the opposite wall of the carriage. Gear 42 in turn engages a pinion 45 mounted on front wheel axle 21.

Thus when the player propels the vehicle along the ground or a flat running surface in the forward direction, front wheel axle 21 turns in the clockwise direction and through pinion 45 rotates cluster gear 42 in the counterclockwise direction. As a result, pinion 41 of the cluster gear also rotates in the counterclockwise direction and turns arbor gear 40 clockwise to wind spiral spring 38, thereby energizing the spring motor.

Figure 9C:
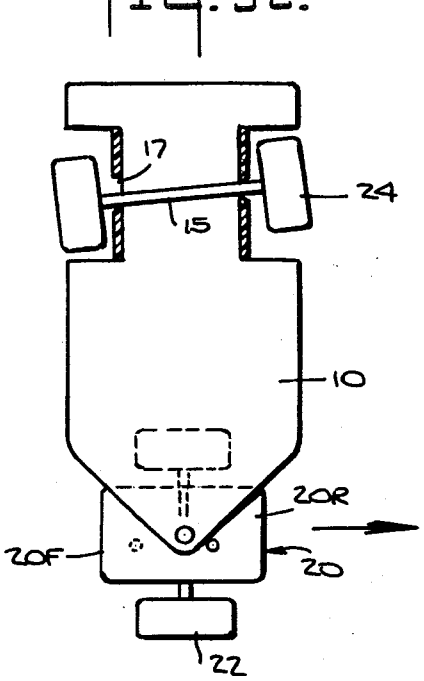
FIGS. 9A to 9E schematically illustrated in a series of steps the manner in which the chassis of the vehicle swings in a 180 degree arc to assume a position behind the carriage as the vehicle returns to its starting point.
Figure 9B:
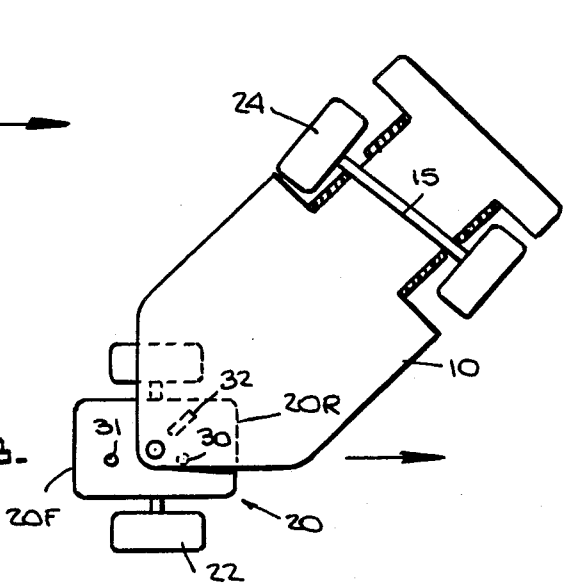
Figure 9A:
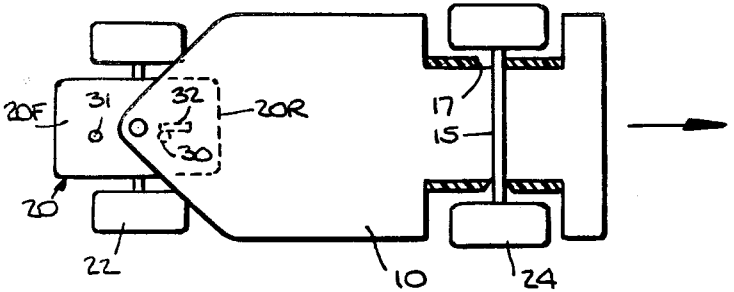

At the end of the forward run, spring 48 proceeds to unwind, and through the gear train constituted by gears 40, 41, 42 and 45 causes the front wheel axle to turn in the counterclockwise direction, thereby causing the carriage to travel in the reverse direction toward the starting point, as shown in FIG. 9A.

Figure 9E:
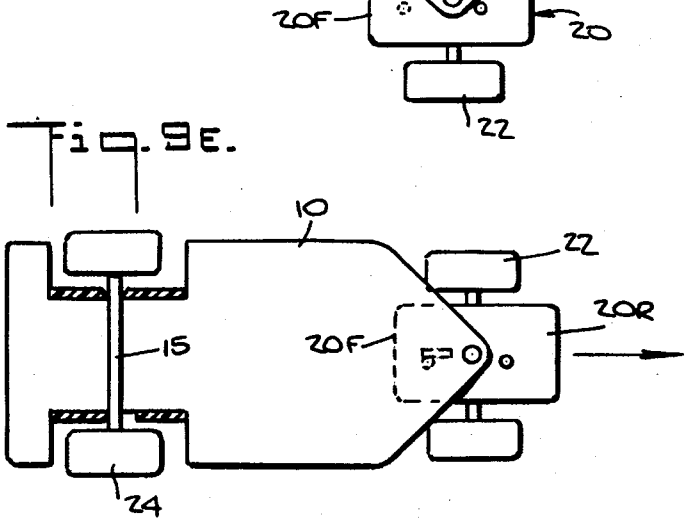
Figure 9D:
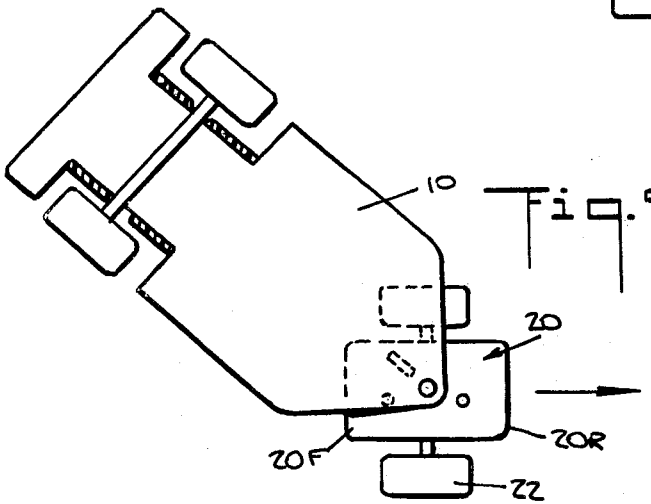

But because the rear wheel axle is angularly displaceable, the movement of carriage 20 in the reverse direction causes angular displacement of the rear axle, as a consequence of which chassis 11, whose rear section is supported on the rear wheels, proceeds to swing in an arc relative to the pivot point on the carriage, as shown in FIG. 9B. As the carriage continues to run toward the starting point, chassis 11, as shown in FIGS. 9C and D, executes a 180° swing so that it finally assumes a position, as shown in FIG. 9E, behind carriage 20. Hence the vehicle in its return trip has effectively turned around and does not travel backwards, but with its body in the forward position.

However, in the return trip, the carriage is reversed in orientation relative to the chassis and the body thereon, so that rear wall 20R of the carriage is at the front of the vehicle. Hence, before the next play, it is necessary to restore the carriage to its normal orientation. This occurs automatically by picking the vehicle up from the ground, at which point the charged sector-gear mechanism acts to reorient the carriage so that it resumes its normal orientation with the front wall 20F in front of the vehicle.

Because cluster gear 42 is in a slotted bearing, when the spring motor is exhausted, the momentum of the vehicle continues to carry it back to its starting point, for pinion 45 on the front wheel axle, which is no longer driven from gear 42, angularly displaces this gear to prevent it from interfering with rotation of the axle.

While there has been shown and described a preferred embodiment of a self-returning toy vehicle in accordance with the invention, it will be appreciated that many changes and modifications may be made therein without, however, departing from the essential spirit thereof.

I claim:

1. A four-wheeled toy vehicle when propelled forward by a player from a starting point along a flat surface in the forward direction acts to store energy, the vehicle at the end of its forward run being caused by the stored energy to reverse its orientation as it runs back toward the starting point, said toy comprising:

A. a chassis having a front cowl projecting therefrom;

B. a front wheel carriage disposed below the cowl, the carriage being coupled to the cowl by a pivot pin whereby the carriage orientation is reversible relative to the cowl from a normal to a reverse orientation, said carriage having a spring motor therein operatively coupled to a front wheel axle for the front wheels which when rotated during the forward run of the toy acts to wind up the motor;

C. a rear wheel axle supported in bearings at the rear section of the chassis, one of which is slotted to permit angular displacement of the axle, whereby at the end of the forward run, the energized motor then acts to drive the front wheel carriage in the reverse direction to cause angular displacement of the rear axle, as a result of which the chassis swings in an arc to assume a position behind the front wheel carriage as it returns toward the starting point.

2. A toy as set forth in claim 1, further including an automobile car body supported on the chassis.

3. A toy as set forth in claim 1, wherein said carriage is provided with two spaced stops at the top wall thereof which cooperate with an abutment depending from the cowl, whereby the carriage position is restricted to said normal and said reverse orientations.

4. A toy as set forth in claim 1, further including a spring-biased gear mechanism coupled to the pivot pin, the mechanism being charged as the chassis swings behind the carriage and acting when the vehicle is thereafter lifted from the surface to rotate the carriage so that it resumes its normal orientation.

5. A toy as set forth in claim 4, wherein said mechanism includes a sector gear mounted on a pivoted arm and engaging a pinion mounted on the pivot pin, and a spring connected between a post anchored on the chassis and said arm.

6. A toy as set forth in claim 1, wherein said spring motor is constituted by a spiral spring concentric with the front wheel axle, the inner end of the spring being attached to an arbor through which this axle freely extends, the arbor having an arbor gear operatively coupled to the front wheel axle.

7. A toy as set forth in claim 6, further including a pinion mounted on said front wheel axle to engage a gear mounted on a parallel axle provided with a pinion which engages the arbor gear.

* * * * *